US012059113B2

(12) United States Patent
Durham et al.

(10) Patent No.: US 12,059,113 B2
(45) Date of Patent: Aug. 13, 2024

(54) DIVERTER ASSEMBLY FOR DISHWASHER

(71) Applicant: Haier US Appliance Solutions, Inc., Wilmington, DE (US)

(72) Inventors: Kyle Edward Durham, Louisville, KY (US); Christopher Brandon Ross, Louisville, KY (US); Brian Steven Riddle, Taylorsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 256 days.

(21) Appl. No.: 17/712,653

(22) Filed: Apr. 4, 2022

(65) Prior Publication Data

US 2023/0309780 A1 Oct. 5, 2023

(51) Int. Cl.
*A47L 15/42* (2006.01)

(52) U.S. Cl.
CPC ..... *A47L 15/4221* (2013.01)

(58) Field of Classification Search
None
See application file for complete search history.

(56) References Cited

U.S. PATENT DOCUMENTS

| | | | |
|---|---|---|---|
| 9,307,886 | B2 | 4/2016 | Durham et al. |
| 9,737,191 | B2 | 8/2017 | Durham et al. |
| 9,980,624 | B2 | 5/2018 | Hofmann et al. |
| 2015/0230687 | A1 | 8/2015 | Dries et al. |
| 2017/0071441 | A1* | 3/2017 | Durham ..... F16K 31/52483 |

* cited by examiner

*Primary Examiner* — Levon J Shahinian
(74) *Attorney, Agent, or Firm* — Dority & Manning, P.A.

(57) ABSTRACT

A dishwasher is provided having a diverter assembly. The diverter assembly may include a diverter disk moveable between an upper and a lower position. The diverter disk may include a diverter head defining an opening and a radial center, and a disk boss attached to the diverter head at a radial center of the diverter head. The disk boss may define a disk channel extending below the diverter head. The diverter disk may further include an upper spring guide extending below the disk boss and located within the disk channel, a return spring extending below the upper spring guide within the disk channel, and a lower spring guide extending through the return spring. The return spring may have a top end attached to the upper spring guide and a bottom end attached to the lower spring guide.

19 Claims, 15 Drawing Sheets

DIVERTER ASSEMBLY FOR DISHWASHER

FIELD OF THE INVENTION

The present subject matter relates generally to dishwasher appliances and more particularly to diverters within dishwasher appliances.

BACKGROUND OF THE INVENTION

Dishwasher appliances generally have a wash chamber with at least one spray assembly and at least one rack assembly, and a pump system to motivate fluid to the at least one spray assembly, which may wash articles placed within the at least one rack assembly. In some dishwasher appliances, a diverter assembly is in fluid communication with the pump system or a part of the pump system to divert fluid to different paths along the pump system, such as to different spray assemblies within the wash chamber. The diversion of fluid to different paths can allow the dishwasher appliance to operate in different modes during washing or rinsing. Some diverter assemblies include a passive diverter disk that rotates, physically selecting a mode or flow path for fluid from a selection of flow paths or different modes by adjusting the position of the diverter disk. Some diverter disks may also move up and down to control the flow of fluid through the diverter in between modes.

Current technology of passive diverters utilized in dishwasher may use a flow pressure force from the circulation pump outlet stream to move the diverter disk in the diverter in one direction (e.g., vertically upward) and either gravity or spring forces to move the diverter disk (e.g., vertically downward) upon deactivation of the circulation pump. In some cases, spring force may be preferred as being stronger than gravity alone when the diverter disk is moving in the presence of fluids.

However, while spring force may be desired as the acting force generator during deactivation of the circulation pump, it can be difficult to implement a spring into the design of such diverters. Assembling a spring assembly within the diverter assembly in addition to aligning parts that coordinate the rotational movement of the diverter disk is often a complex process. Such may be especially challenging in dishwasher appliances that have a diverter mechanism that is integrated into a sump. Difficulties may also exist with containing numerous small or awkward parts within the diverter assembly while aligning the diverter assembly inside the sump. This may result in a complex and costly assembly.

Accordingly, a passive diverter in a dishwasher appliance having one or more features for an efficient, easy, or robust assembly may be desirable. Additionally or alternatively, a passive diverter that utilizes spring force (e.g., while being easily assembly) may be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwasher is provided. The dishwasher appliance may define a transverse, a lateral and a vertical direction. The dishwasher may include a wash chamber for receipt of articles for washing, a pump, a spray assembly, and a diverter assembly. The diverter assembly may be in fluid communication with the pump. The diverter assembly may define an axial direction a radial direction and a circumferential direction. The diverter assembly may include a diverter disk moveable along the axial direction between an upper and a lower position. The diverter disk may include a diverter head, a disk boss, an upper spring guide, a return spring, and a lower spring. The diverter head may define an opening and a radial center. The disk boss may be attached to the diverter head at a radial center of the diverter head. The disk boss may define a disk channel extending along the axial direction below the diverter head. The upper spring guide may extend below the disk boss and may be located within the disk channel. The return spring may have a top end and a bottom end. The top end may be attached to the upper spring guide. The return spring may extend below the upper spring guide within the disk channel. The lower spring guide may be attached to the bottom end of the return spring and may extend axially therethrough.

In another exemplary aspect of the present disclosure, a diverter assembly for a dishwasher appliance is provided. The diverter assembly may be in fluid communication with a pump. The diverter assembly may define an axial direction, a radial direction, and a circumferential direction. The diverter assembly may include a diverter disk moveable along the axial direction between an upper and a lower position. The diverter disk may include a diverter head, a disk boss, an upper spring guide, a return spring, and a lower spring guide. The diverter head may define an opening and a radial center. The disk boss may be attached to the diverter head at the radial center of the diverter head. The disk boss may define a disk channel extending along the axial direction. The upper spring guide may extend below the disk boss and may be located within the disk channel. The return spring may have a top end and a bottom end. The top end may be attached to the upper spring guide. The return spring may extend below the upper spring guide within the disk channel. The lower spring guide may be attached to the bottom end of the return spring and may extend axially therethrough.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same of similar reference numerals in the figures denotes the same or similar features unless the context indicates otherwise.

DETAILED DESCRIPTION

Figure 1:
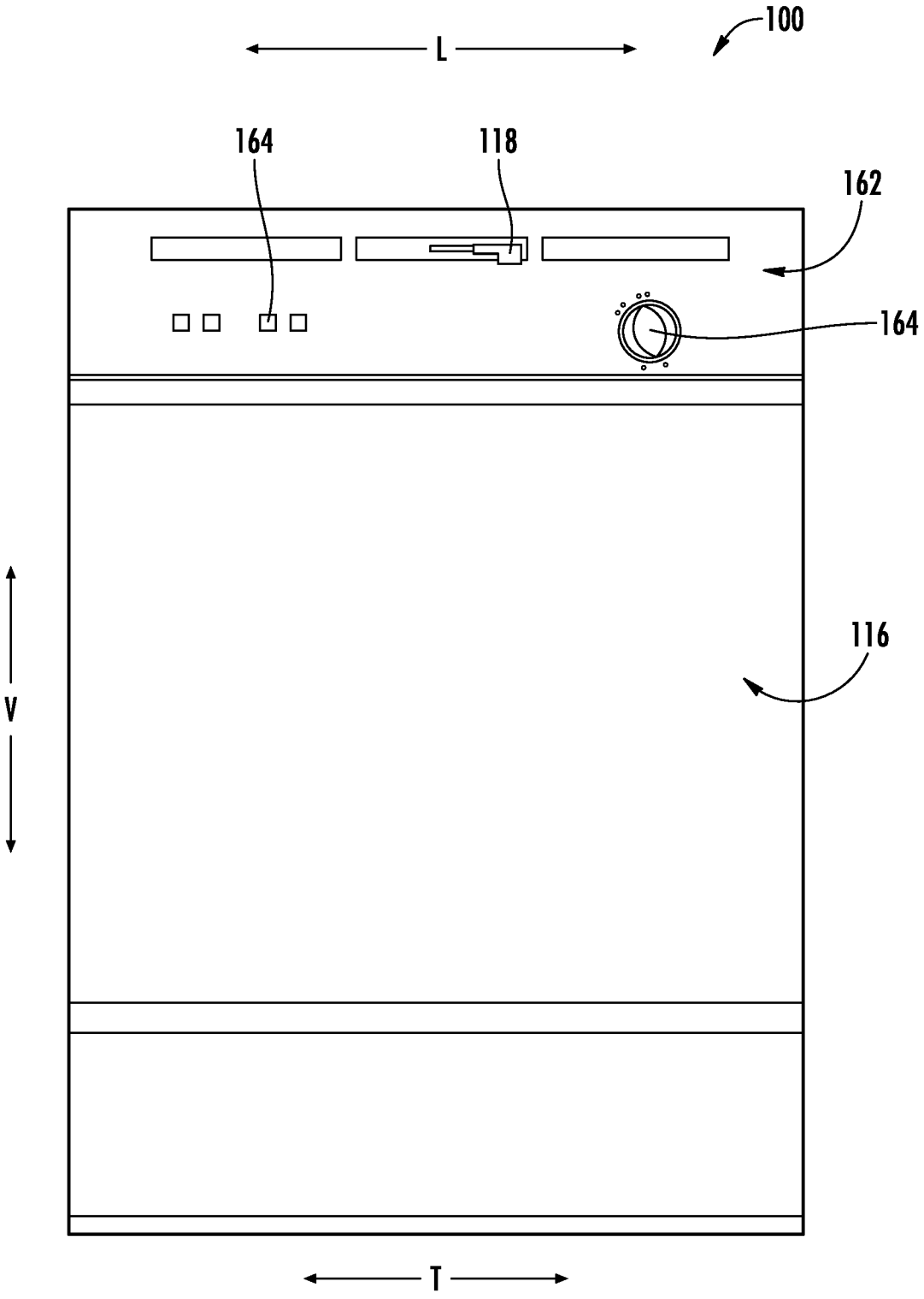
FIG. 1 provides a perspective view of an exemplary embodiment of a dishwasher appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

As used herein, the term "article"" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "cleaning cycle" is intended to refer to one or more periods of time that may include a wash cycle, rinse cycle, or a drain cycle. The term "wash fluid" refers to a liquid used for washing or rinsing the articles and is typically made up of water that may include other additives such as detergent or other treatments.

Appliances described herein may include diverter assemblies that include springs to aid in returning a diverter disk to a resting position while also being assembled readily. Advantageously, diverter assemblies described herein may have the benefit of being a passive system, with the benefits of a simple construction, to allow for improved performance of the diverter without the use of motors while also increasing the simplicity of assembly or installation of the diverter assembly. Springs may enhance the effectiveness of the diverter between fluid patterns, while not requiring precise, complex installation in order to assemble the diverter assembly.

Figure 2:
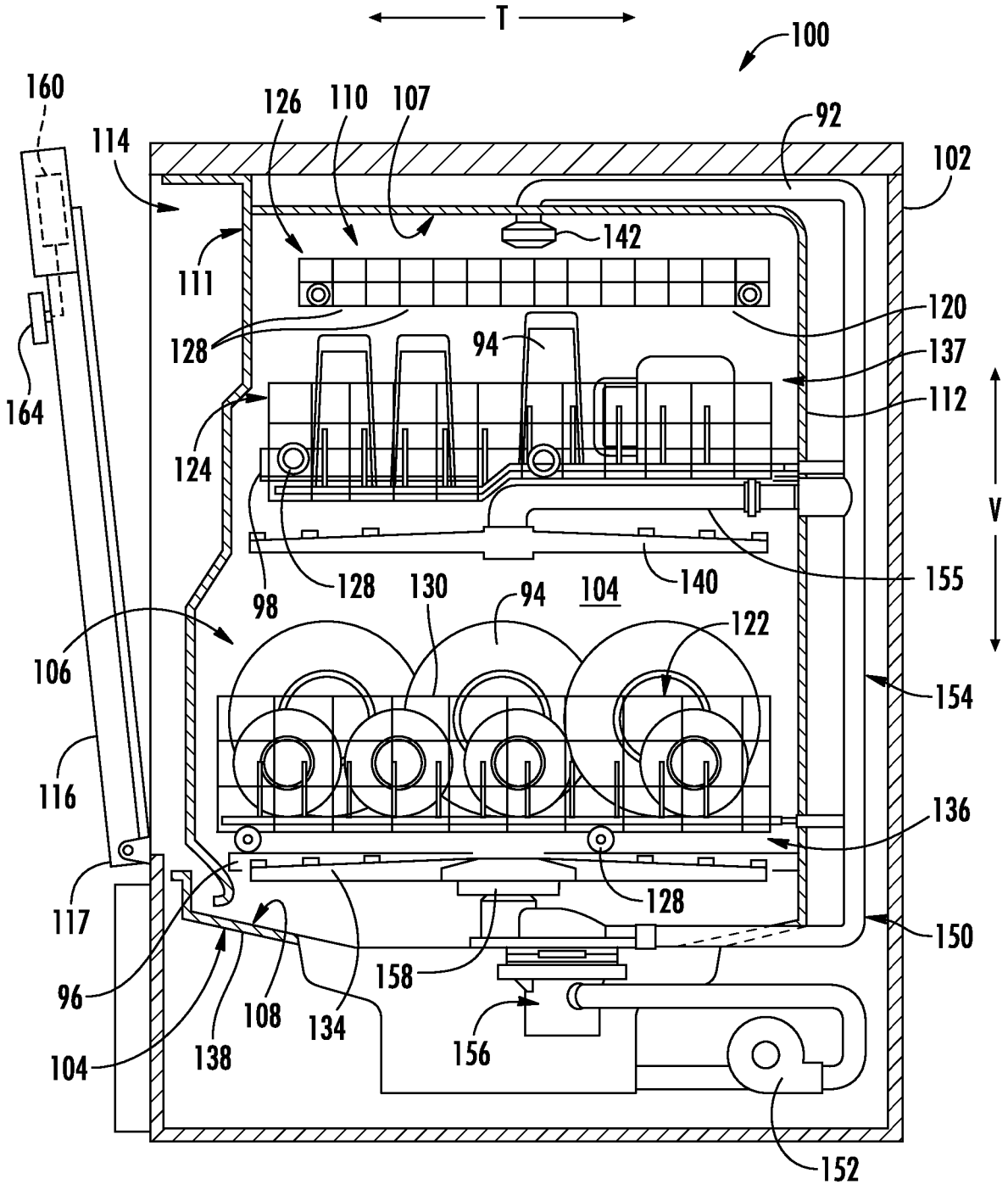
FIG. 2 provides a side, cross sectional view of the exemplary dishwasher appliance of FIG. 1.

FIGS. 1 and 2 depict an exemplary domestic dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106 for receipt of articles 94 for washing. As shown in FIG. 2, tub 104 extends between a top 107 and a bottom 108 along a vertical direction V, between a pair of opposing side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom 117 for movement between a normally closed vertical position (shown in FIG. 1) wherein the wash chamber 106 is sealed shut for washing operation and a horizontal open position for loading and unloading articles 94 from dishwasher 100. According to exemplary embodiments, dishwasher appliance 100 further includes a door closure mechanism or assembly 118 that is used to lock and unlock door 116 for accessing and sealing wash chamber 106.

At least one rack assembly is slidably positioned within wash chamber 106 and is configured for the receipt of articles for washing. For the exemplary embodiment shown in FIG. 2, opposing tub side walls 110 accommodate a plurality of rack assemblies 122, 124, 126. Guide rails 96, 98 and 120 may be mounted to (or formed as part of) side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack 122, 124, 126 is adapted for movement between an extended loading position (not shown) in which the rack is substantially positioned outside the wash chamber 106. This may be facilitated, for example, by rollers 128 mounted onto rack assemblies 122, 124, 126, respectively.

Some or all of the rack assemblies 122, 124, 126 may be fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles 94 within wash chamber 106 while allowing a flow of wash fluid to reach and impinge on those articles, e.g., during a cleaning or rinsing cycle. For some embodiments, a silverware basket (not shown) is removably attached to a rack assembly, e.g., lower rack assembly 122, for placement of silverware, utensils, and the like, that are otherwise too small or delicate to be accommodated by rack 122.

At least one spray assembly is located in wash chamber 106 and is configured to direct wash fluids onto at least on rack assembly for washing articles located therein. For the exemplary embodiment of FIG. 2, dishwasher appliance 100 further includes a plurality of spray assemblies for urging a flow of water or wash fluid onto the articles placed within wash chamber 106. More specifically, as illustrated in FIG. 2, dishwasher appliance 100 includes a first spray assembly 134 (also referred to as a lower spray arm assembly 134) disposed in a lower region 136 of wash chamber 106 and above a sump 138 so as to rotate in relatively close proximity to lower rack assembly 122. Similarly, a second spray assembly 140 (also referred to as a mid-level spray arm assembly 140) is located in an upper region 137 of wash chamber 106 and may be located below and in close proximity to middle rack assembly 124. In this regard, mid-level spray arm assembly 140 may generally be configured for urging a flow of wash fluid up through middle rack assembly 124 and third rack assembly 126. Additionally, an upper or third spray assembly 142 (also referred to as an upper spray assembly 142) may be located above upper or third rack assembly 126 along the vertical direction V. In this manner, third spray assembly 142 may be configured for urging or cascading a flow of wash fluid downward over rack assemblies 122, 124, and 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear side 112 of tub 104 along the vertical direction V to supply wash fluid throughout wash chamber 106. In some examples, a secondary supply conduit 92 may supply additional wash fluid to one or more various spray assemblies and manifolds.

As illustrated, primary supply conduit 154 is used to supply wash fluid to mid-level spray arm assembly 140 while secondary supply conduit 92 supplies wash fluid to upper spray assembly 142. Diverter assembly 156 can allow selection between spray assemblies 134 and 140, 142 being supplied with wash fluid. However, it should be appreciated that according to alternative embodiments, any other suitable plumbing configuration may be used to supply wash fluid throughout the various spray manifolds and assemblies described herein.

Each spray assembly 134, 140, 142 or other spray device may include an arrangement of discharge ports or orifices for directing wash fluid received from pump 152 onto dishes or other articles 94 located in wash chamber 106. The arrangement of the discharge ports, also referred to as jets, apertures, or orifices, may provide a rotational force by virtue of wash fluid flowing through the discharge ports. Alternatively, spray assemblies 134, 140, 142 may be motor-driven, or may operate using any other suitable drive mechanism. Spray manifolds and assemblies may also be stationary. Movement of the spray arm assemblies 134 and 140 and the spray from fixed manifolds like spray assembly 142 provides coverage of dishes, silverware, and other dishwasher contents and articles 94 to be cleaned with a washing spray. Other configurations of spray assemblies may be used as well. For example, dishwasher appliance 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156, e.g., which is positioned within sump 138 of dishwasher appliance 100. As will be described in greater detail below, diverter assembly 156 may include a diverter disk 212 disposed within a diverter cover 214 for selectively distributing the wash fluid to spray assemblies 134, 140, 142 or other spray manifolds or devices. For example, diverter disk 212 may have a plurality of apertures (e.g., apertures 224, 226, 228) that are configured to align with one or more outlet ports (e.g., outlet ports 202, 204) attached to diverter top 216. In this manner, diverter disk 212 may be selectively rotated to provide wash fluid to the desired spray device (e.g., spray assemblies 134, 140, 142).

According to an exemplary embodiment, diverter assembly 156 is configured for selectively distributing the flow of wash fluid from pump 152 to various fluid supply conduits, only some of which (e.g., 154) are illustrated in FIG. 2 for clarity. More specifically, diverter assembly 156 may include four outlet ports (e.g., outlet ports in FIGS. 3, 4) for supplying wash fluid to primary supply conduit 154, to a lower supply conduit 158, to secondary supply conduit 92, or to a middle supply conduit 155. Some outlet ports may be configured to induce spray that rotates one or more spray assemblies 134, 140,142 in a clockwise or counterclockwise direction. In some examples, one outlet port (e.g., one of outlet ports 224, 226, 228 in FIG. 3) may direct fluid to one conduit (e.g., In some embodiments, one outlet port (e.g., outlet port 224) may direct fluid to flow to a conduit to rotate a spray assembly (e.g., lower spray assembly 134) in a clockwise direction while another outlet port (e.g., outlet port 226) directs fluid to flow to a conduit to rotate a spray assembly (e.g., lower spray assembly 134) in a counterclockwise direction. Other configurations of diverter assembly 156 or other components (e.g., valves) may be used to allow various choices in the operation of the spray assemblies 134, 140, and 142 during a cleaning cycle.

The dishwasher appliance 100 is further equipped with a controller 160 (FIG. 2) to regulate operation of the dishwasher appliance 100. Controller 160 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

The controller 160 may be positioned in a variety of locations throughout dishwasher appliance 100. In the illustrated embodiment, the controller 160 may be located within a control panel area 162 of door 116. In such an embodiment, input/output ("I/O") signals may be routed between the control system and various operational components of dishwasher appliance 100 along wiring harnesses that may be routed through the bottom of door 116. Typically, the controller 160 includes a user interface panel/controls 164 (FIG. 1) through which a user may select various operational features and modes and monitor progress of the dishwasher appliance 100. In one embodiment, the user interface 164 may represent a general purpose I/O ("GPIO") device or functional block. In one embodiment, the user interface 164 may include input components, such as one or more of a variety of electrical, mechanical, or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher appliance 100. The exemplary embodiment depicted in FIGS. 1 and 2 is for illustrative purposes only. For example, different locations may be provided for user interface 164, different configurations, including providing one or more rack assemblies 122, 124, 126 and one or more spray assemblies 134, 140, 142, to dishwasher appliance 100 may be used, different configurations may be provided for rack assemblies 122, 124, 126, different spray assemblies 134, 140, 142 and spray manifold configurations may be used, and other differences may be applied while remaining within the scope of the present subject matter.

Figure 3:
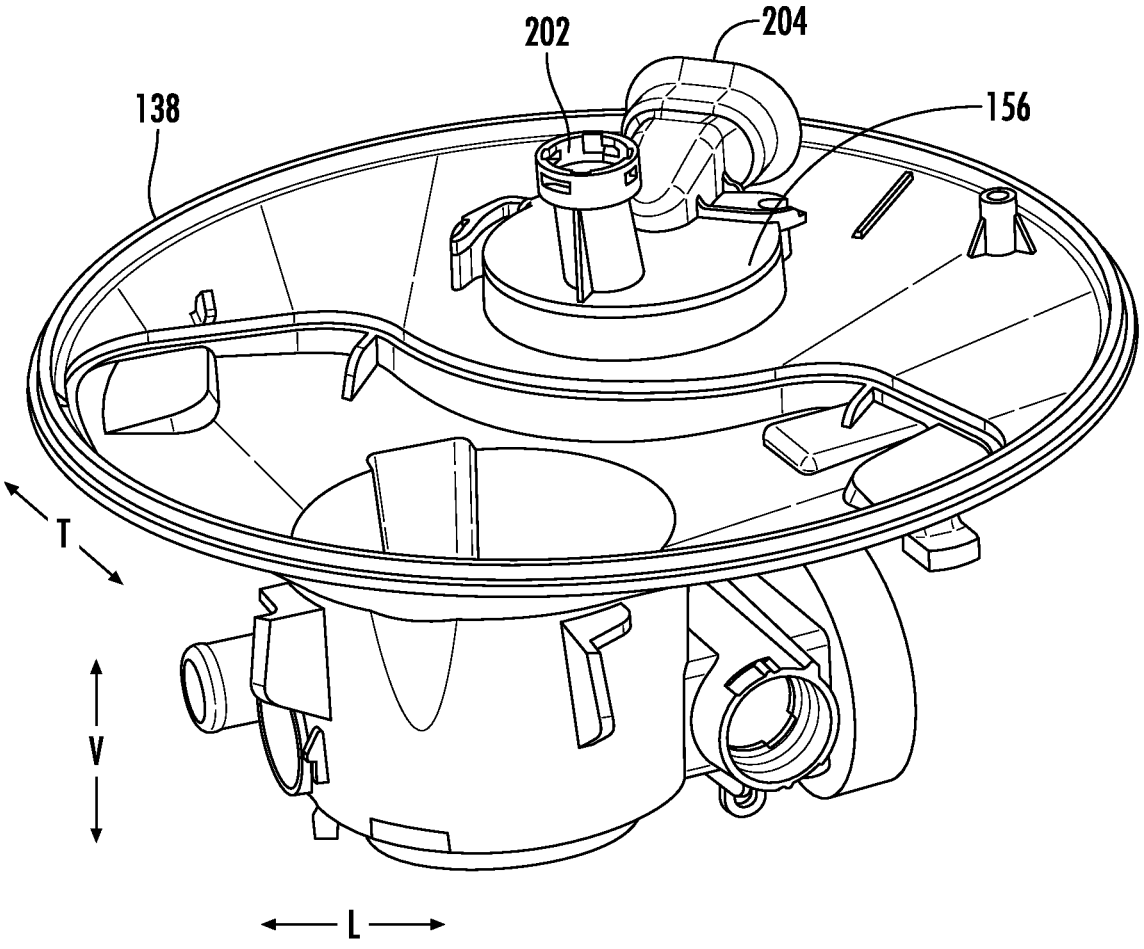
FIG. 3 provides a perspective view of an exemplary diverter assembly and sump of the present disclosure.

FIG. 3 provides a perspective view of sump 138 with diverter assembly 156. As shown, diverter assembly 156 is located within sump 138. Diverter assembly 156 includes multiple outlet ports 202, 204 to direct fluid from pump 152, through diverter assembly 156, to fluid circulation assembly 150, and to spray assemblies 134, 140, 142. Though two ports, first outlet port 202 and second outlet port 204, are shown in FIGS. 3 and 4, in other embodiments, three, four or more than four outlet ports may be used with diverter assembly 156 (e.g., depending on the number of switchable ports desired for selectively placing pump 152 in fluid communication with different fluid-using elements of appliance 100).

Figure 4:
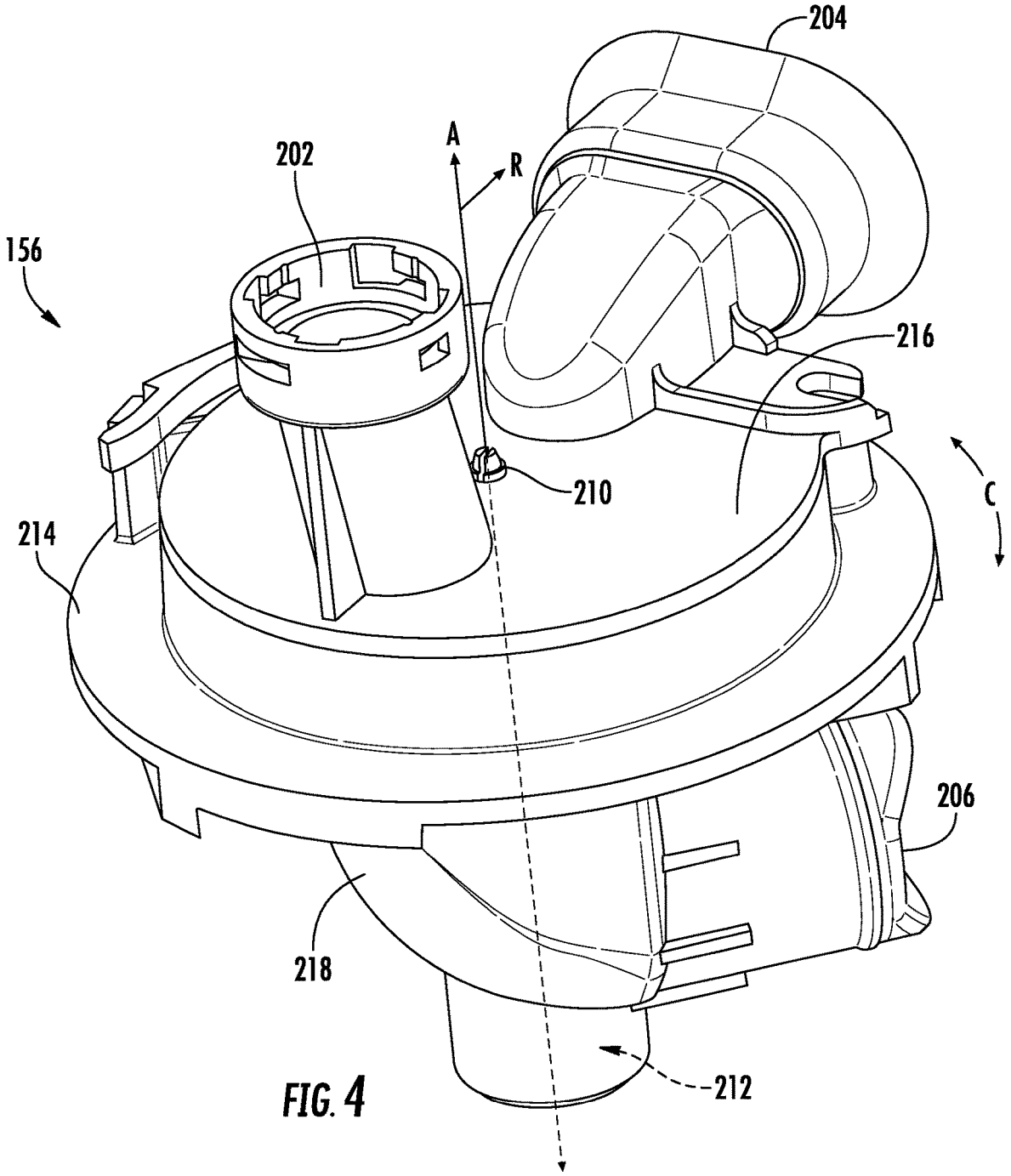
FIG. 4 provides a perspective view of a portion of the diverter assembly of FIG. 3.

FIG. 4 provides a perspective view of diverter assembly 156. Diverter assembly 156 defines an axial direction A, a radial direction R, and a circumferential direction C. Axial direction A may be defined, for instance, through diverter pin 210 and diverter disk 212 (see e.g., FIGS. 5 and 6), Diverter assembly 156 has a fluid inlet 206 for receiving a flow of fluid from pump 152 that is to be supplied to spray assemblies 134, 140, or 142 as well as other fluid-using components during cleaning operations. As stated, pump 152 receives fluid from, e.g., sump 138 and provides a fluid flow to diverter assembly 156.

Figure 5:
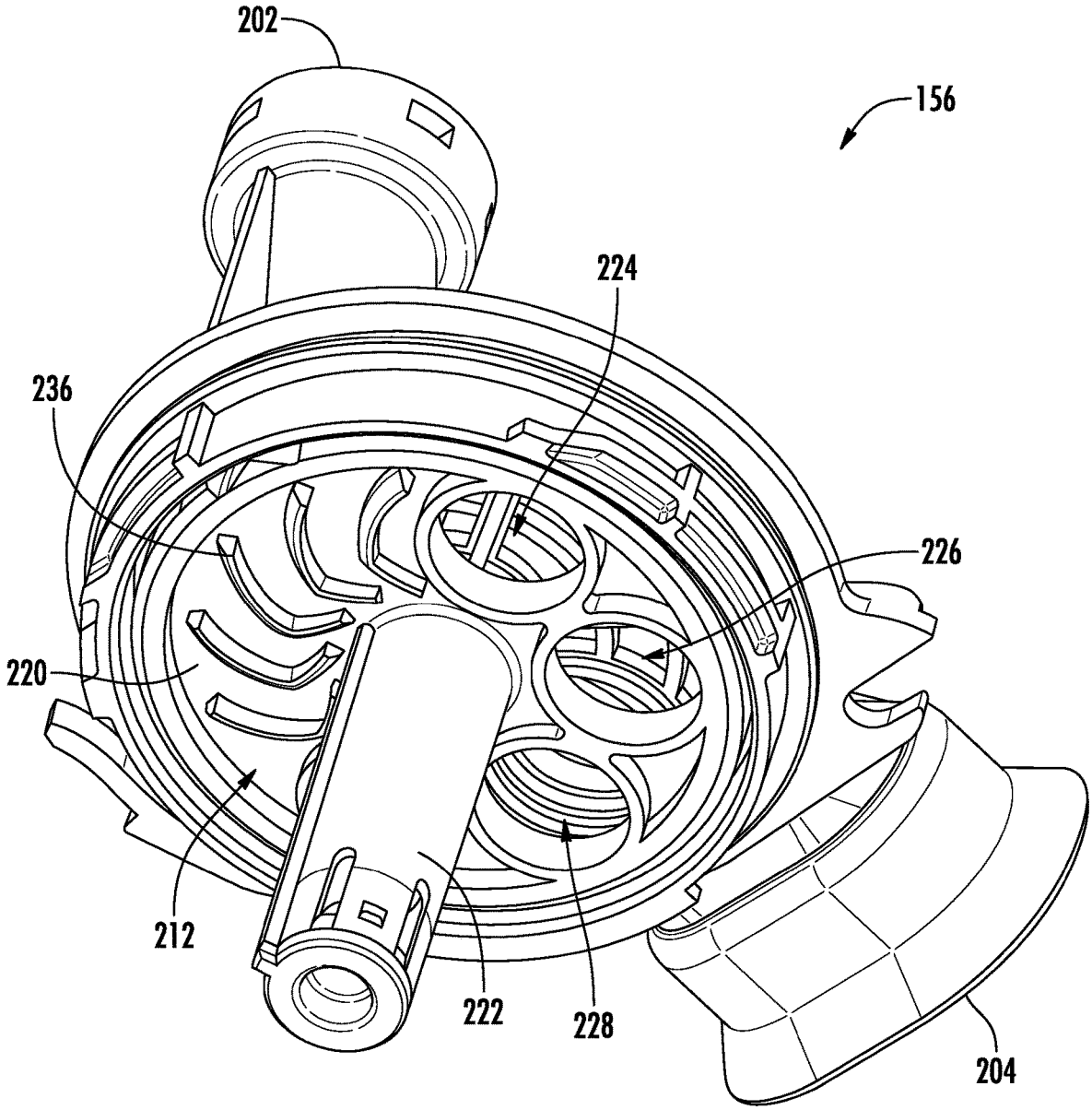
FIG. 5 provides an underside perspective view of a portion of the diverter assembly of FIG. 3.

As shown, diverter assembly 156 includes a diverter cover 214 which includes a diverter top 216, connected to a diverter bottom 218. Diverter cover 214 is configured to contain fluid as fluid flows from pump 152 through diverter assembly 156 during cleaning cycles. Located inside diverter cover 214 is a diverter disk 212 (e.g., as shown in FIG. 5). The diverter disk 212 includes a diverter head 220 and a disk boss 222. Disk boss 222 is attached to diverter head 220 at a radial center of diverter head 220. As will be explained in more detail below, diverter disk 212 is moveable in the axial direction A and the circumferential direction C to aid in directing fluid from pump 152 to spray assemblies 134, 140, 142.

As shown in FIG. 5, diverter assembly 156 includes a diverter head 220 connected to a disk boss 222. In some embodiments, diverter head 220 is a circular piece of appliance 100. Disk boss 222 may extend from a central portion of diverter head 220. Disk boss 222 may be movable (e.g., rotatable about an axial direction A). During use, diverter head 220 is rotated to align different ports (e.g., ports 224, 226,228) to different diverter outlets (e.g., outlets 202 or 204) to generate different fluid flow patterns during cleaning cycles. Disk boss 222 turns with diverter head 220 to manipulate different flow patterns through diverter assembly, as described herein and as otherwise understood. In optional embodiments, diverter head 220 and disk boss 222 are also moveable in vertical direction V (or axial direction A), which may aid in aligning different ports to different diverter outlets, as will be described in more detail (e.g., see FIGS. 15 and 16).

Diverter head 220 generally defines a plurality of apertures (e.g., one or more of 224, 226, 228, or 229) and a plurality of arcuate ribs 236. Diverter head 220 can be selectively switched between apertures 224, 226, or 228 by using diverter pin 210 in combination with an upper spring guide 230, a lower spring guide 232, or a return spring 234 as will be described in more detail below (see e.g., FIGS. 6 through 11).

By way of example, first outlet port 202 may be fluidly connected with lower spray assembly 134, and second outlet port 204 may be fluidly connected with mid-level spray assembly 140 and upper spray assembly 142. As such, rotation of diverter head 220 in diverter assembly 156 with pin 210 can be used to selectively place pump 152 in fluid communication with spray assemblies 134, 140 or 142 by way of apertures 224, 226 or 228.

Arcuate ribs 236 may extend from diverter head 220 (e.g., in axial direction A toward disk boss 222) and may be curved or straight (e.g., along a radial path from the axial direction A). During use, arcuate ribs 236 may act to capture the momentum of the fluid flow and may tend to cause the diverter head 220 to rotate in only one direction (e.g., a clockwise direction about an axial direction A in circumferential direction C). As shown in FIG. 5, diverter disk 212 may include four accurate ribs 236. However, one skilled in the art will appreciate that any number of arcuate ribs may be used. Similarly, the ribs may be different size, shape, or orientation depending on the needs of the application. Other configurations may be used in embodiments as described herein or as otherwise understood.

Turning generally to FIGS. 6 through 14, diverter disk 212 includes a diverter head 220, a disk boss 222, an upper spring guide 230, a return spring 234, and a lower spring guide 232. Diverter head 220 further defines an opening 221 and a radial center DR. Generally, disk boss 222 is a tube or open shaft extending from diverter head 220 around radial center DR. Disk boss 222 generally extends downwards in axial direction A from disk head 220. In some embodiments, disk boss 222 is generally cylindrical in shape. Disk boss 222 defines an upper opening 242 that generally aligns with opening 221 of disk head 220 (e.g., along the axial direction A). Disk boss 222 further defines a lower opening 244 located below upper opening 242 (e.g., in axial direction A). Disk boss 222 further defines a disk channel 240 extending within shaft and running the length of disk boss 222 in axial direction A. Upper opening 242 and lower opening 244 generally connect to and abut disk channel 240 forming a top and bottom opening to disk channel 240. Located within disk channel 240 are upper spring guide 230, lower spring guide 232 and return spring 234. In some embodiments, lower spring guide 230 attaches to a boss end 238, with a portion of lower spring guide 230 located within disk channel 240. Generally, disk boss 222 contains upper spring guide 230 and return spring 234 within disk channel 240.

Figure 7:
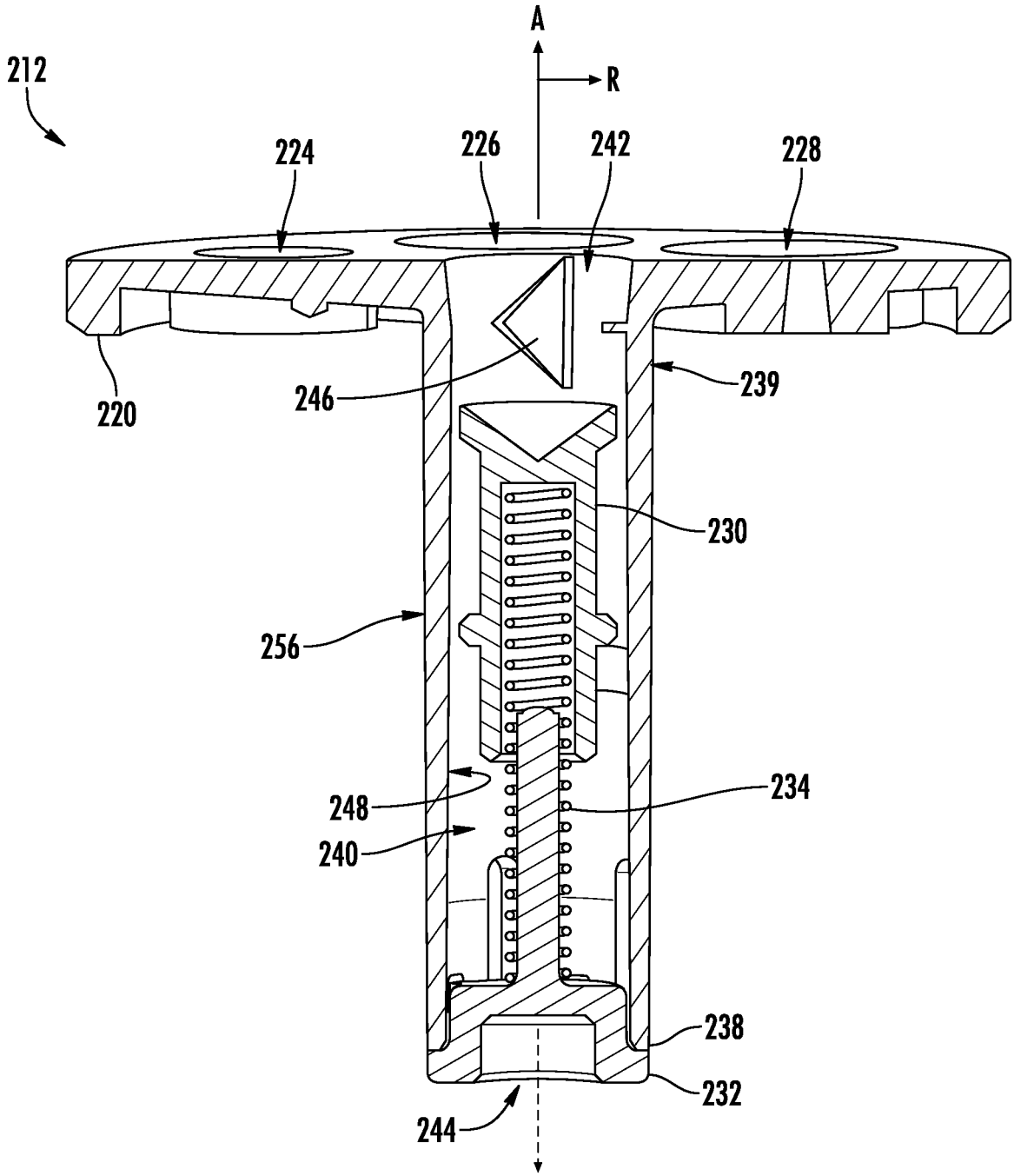
FIG. 7 is a cross-sectional elevation view of the exemplary diverter disk of FIG. 6.
Figure 8:
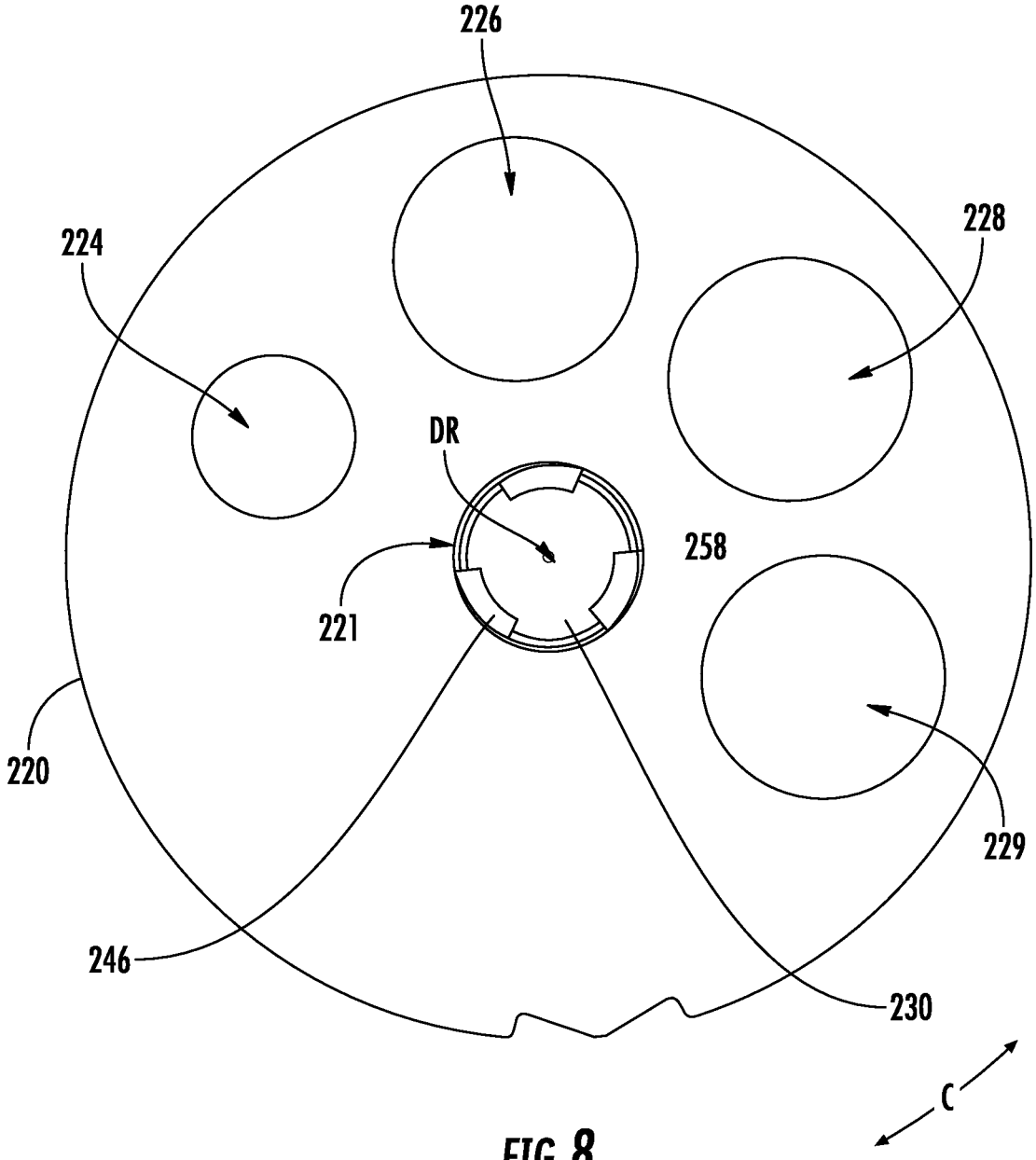
FIG. 8 is a plan view of the exemplary diverter disk of FIG. 6.

Disk channel 240 extends the length of disk boss 222 along axial direction A below diverter head 220. As shown in FIG. 7, disk channel 240 extends through the full upper shaft of disk boss 222 with an upper opening 242 and a lower opening 244. In some embodiments, upper opening 242 is proximal to diverter disk 212 (e.g., in comparison to boss end 238 such that upper opening 242 is closer to diverter disk 212 than boss end 238). In turn, lower opening 244 is proximal to boss end 238, opposite to diverter disk 212 in axial direction A. In some embodiments, disk channel 240 includes an upper portion 239. As shown, grooves 246 extend into disk channel 240 along a disk wall 248 internal to disk boss 222, at upper portion 239 of disk channel 240. In some embodiments, grooves 246 are radial extensions from internal disk wall 248 that may be roughly triangular in shape (e.g., when viewed along the radial direction R). When assembled, grooves 246 may be received within disk channel 240. In turn, grooves 246 may reduce or narrow the open portion of disk channel 240. In some embodiments, the radial thickness of each groove 246 may vary along a length of each groove 246 in circumferential direction C.

In some embodiments, upper opening 242 of disk boss 222 is radially smaller than lower opening 244. For example, upper opening extends from axial direction A in radial direction R for a smaller radial distance than a radial distance of lower opening 244. Upper opening 242 allows pin 210 to enter disk channel 240 and connect with grooves 246. Upper opening 242 has a radial circumference 258 that is radially smaller than radial width of disk channel 240, preventing upper spring guide 230 from leaving disk channel 240. As would be understood, radial circumference 259 may be radially smaller than disk channel 240 and radially larger than upper opening 242. Radial circumference 258 may be radially smaller than lower opening 244.

Additionally or alternatively, disk boss 222 may include a tab opening 250 defined through wall 248 in radial direction R. Some embodiments may have a plurality of tab openings 250 defined along disk boss 222. Further, a plurality of tab notches 252 may be defined along wall 248, extending in axial direction A above boss end 238. In the illustrated embodiment of FIG. 6, an alignment guide 254 also extends along a side of disk boss 222. Alignment guide 254 may extend radially outward from an outer wall 256 of disk boss 222. Tab opening 250 and tab notches 252 may aid in attaching lower spring guide 232 to disk boss 222 at boss end 238. Alignment guide 254 may aid in aligning lower spring guide 232 at boss end 238, as will be discussed in greater detail below.

Diverter pin 210 generally extends in the axial direction from upper portion 239 of disk channel 240 to diverter top 216. As shown, diverter pin 210 includes a central shaft 262 and at least one protrusion 260 extending in radial direction R from central shaft 262. Additionally or alternatively, diverter pin 210 further includes a pin tip 264. Pin tip 264 is generally an axial bottom part of diverter pin 210. Pin tip 264 generally has a conical shape extending axially upwards and outwards in radial direction R towards central shaft 262, which is located above pin tip 264 along axial direction A.

Figure 11A:
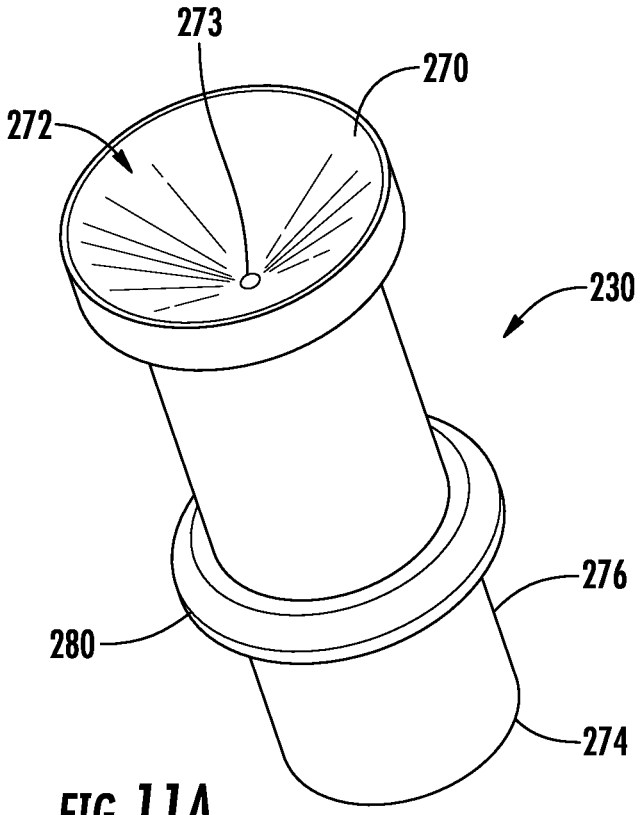
FIGS. 11A and 11B are perspective views of an exemplary upper spring guide of the present disclosure.
Figure 11B:
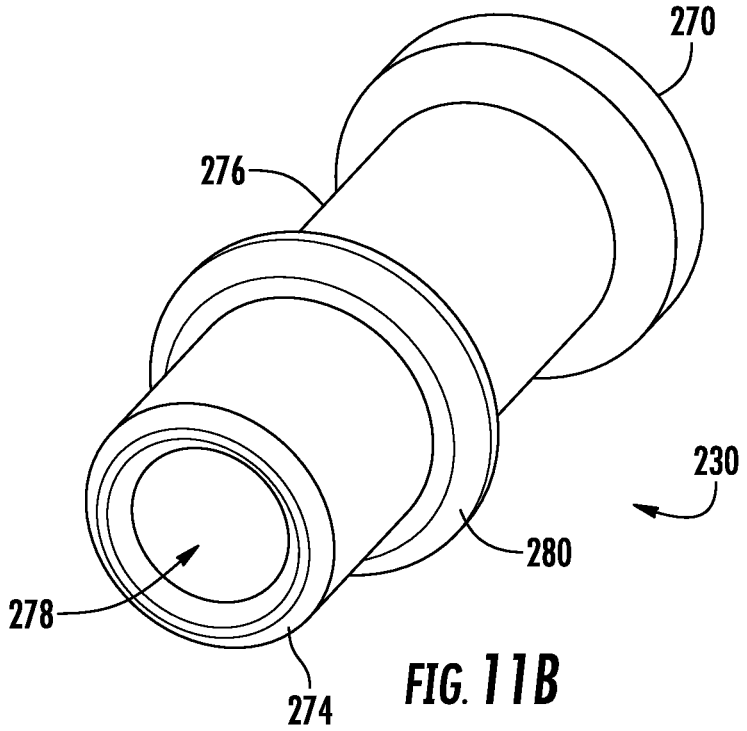

As previously stated, inside disk channel 240 is upper spring guide 230. As shown in FIG. 7, upper spring guide 230 extends below disk boss 222 in axial direction A. As shown in FIGS. 11A and 11B, upper spring guide 230 includes a top surface 270. Top surface 270 may define a conical opening 272. Top surface 270 of upper spring guide 230 may further have a radial circumference 258 that is radially smaller than the lower opening 244 and radially larger than the upper opening 242 of disk boss 222. As shown in FIG. 11A, upper spring guide 230 further includes a base end 274, and an upper shaft 276.

Figure 10:
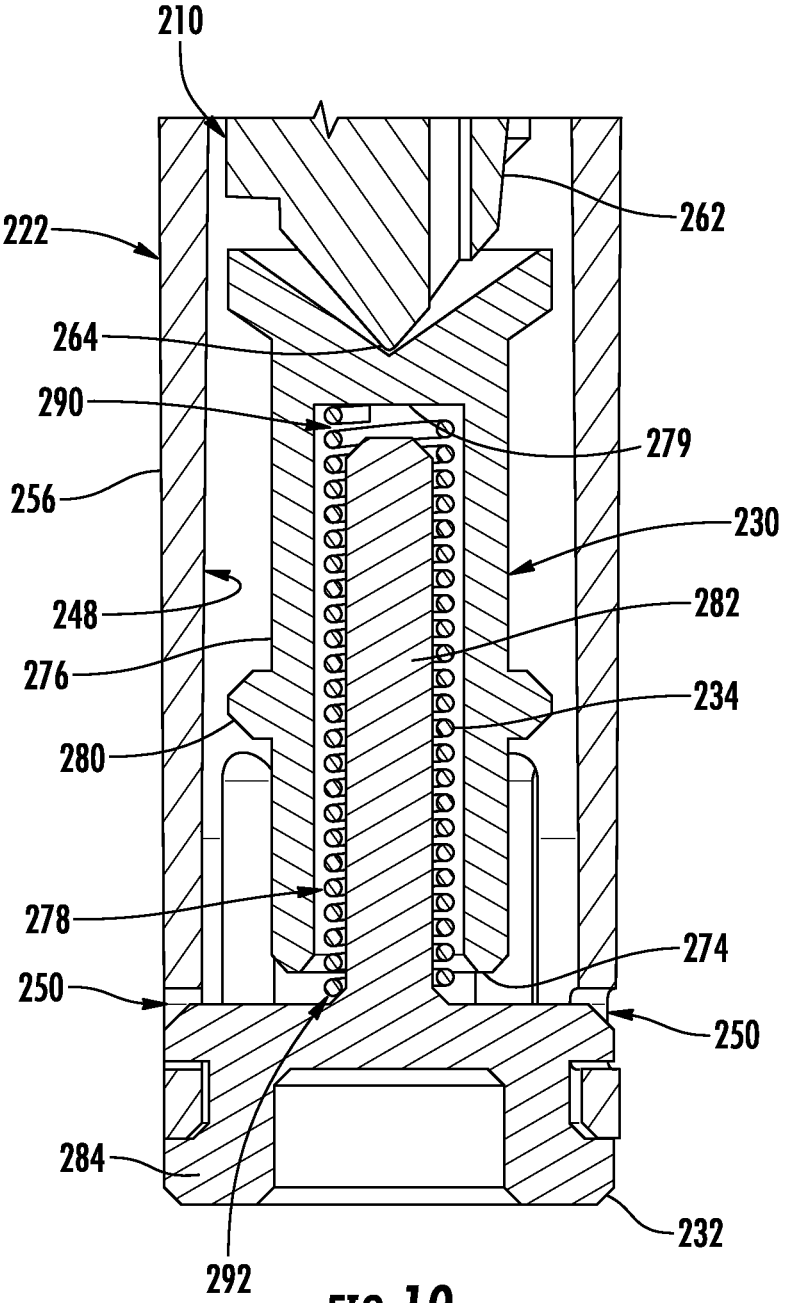
FIG. 10 is a cross-sectional elevation view of a portion of the diverter disk of FIG. 6.

As shown in FIGS. 10 and 11B, upper spring guide 230 further defines a spring channel 278. Spring channel 278 extends from base end 274 of upper spring guide 230 into upper shaft 276 of upper spring guide 230. For example, spring channel 278 may extend into a portion of upper shaft 276. As shown in FIG. 10, spring channel 278 may extend below top surface 270. Spring channel 278 may be cylindrical in shape, centered around axial direction A and extending within upper shaft 276 in radial direction R.

Conical openings 272 may extend downward in axial direction A toward spring channel 278. Conical opening 272 may have an apex 273 that is centrally located within conical opening 272. Apex 273 may be a point closest to spring channel 278 in axial direction A.

Additionally or alternatively, upper spring guide 230 may include an upper ring 280. As shown in FIGS. 11A and 11B, upper ring 280 may be located along upper shaft 276. In some embodiments, upper ring 280 extends beyond upper shaft 276 in radial direction R. In certain embodiments, and as shown in FIG. 10, upper spring guide 230, including upper ring 280, may be disposed within disk channel 240, but may not attach to internal disk wall 248, leaving space between upper spring guide 230 and internal disk wall 248.

Figure 12:
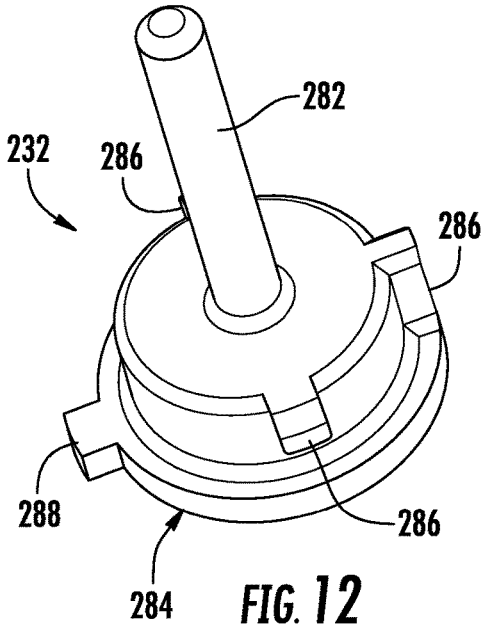
FIG. 12 is an exemplary lower spring guide of the present disclosure.

In some embodiments, upper spring guide 230 is connected to lower spring guide 232. For example, a portion of lower spring guide 232 (e.g., a guide shaft 282) may be removably held within spring channel 278 of upper spring guide 230. Additionally or alternatively, return spring 234 may extend between lower spring guide 232 and upper spring guide 230. Discrete upper and lower portions of return spring 234 may be held within corresponding channel of upper spring guide 230 and around guide shaft 282 of lower spring guide 232, respectively, thereby attaching the guide 230 and guide 232. As shown in FIG. 12, lower spring guide 232 includes a guide shaft 282 and a spring base 284, the guide shaft extending from spring base 284. As shown, guide shaft 282 extends centrally from spring base 284. In particular, guide shaft 282 may extend axially upwards from spring base 284. In some embodiments, guide shaft 282 and spring base 284 form a shape similar to a nail head and a nail shaft, with guide shaft 282 extending from an approximate radial center of spring base 284. Additionally or alternatively, lower spring guide 232 may include a tab 286. In some embodiments, lower spring guide 232 includes more than one tab 286. Tab 286 extends from spring base 284. For example, tab 286 may extend in the radial direction R from spring base 284 (e.g., along a surface that goes around spring base 284 in circumferential direction C). In certain embodiments, lower spring guide 232 further includes an alignment protrusion 288. Alignment protrusion may extend radially out from spring base 284 along a bottom portion of spring base 284. Alignment protrusion 288 may align with alignment guide 254 of disk boss 222, attaching lower spring guide 232 to disk boss 222. Alignment guide 254 may also align tab 286 to tab opening 250 of disk boss 222.

Figure 13:
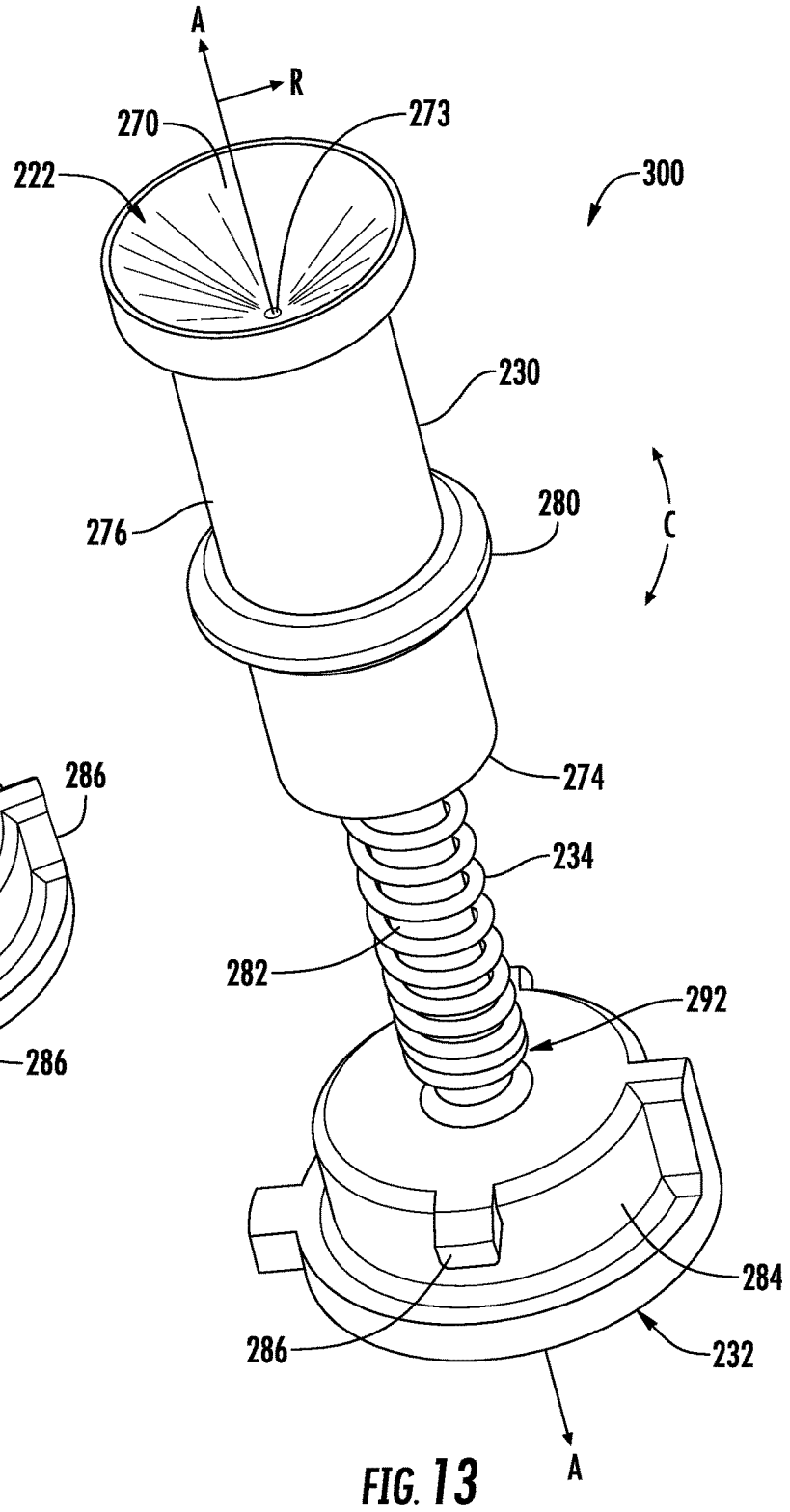
FIG. 13 is a perspective view of an exemplary sub assembly of the present disclosure.

As shown in FIGS. 10 and 13, return spring 234 has a top end 290 and a bottom end 292 (e.g., spaced apart along the axial direction A). Return spring 234 may further include a spring body 294. Spring body 294 may extend between top end 290 and bottom end 292. When assembled, top end 290 is attached to upper spring guide 230. Bottom end 292 is attached to lower spring guide 230. For example, return spring 234 may be sized, in a resting position, to extend a full length of spring channel 278 while simultaneously coiling around a full length of guide shaft 282, bottom end 292 resting on spring base 284. In some embodiments, return spring 234 attaches to upper spring guide 230 within spring channel 278. In some embodiments bottom end 292 of return spring 234 attaches to spring base 284 of lower spring guide 232. Return spring 234 generally extends below upper spring guide within disk channel 240, as shown in FIG. 7.

Figure 14:
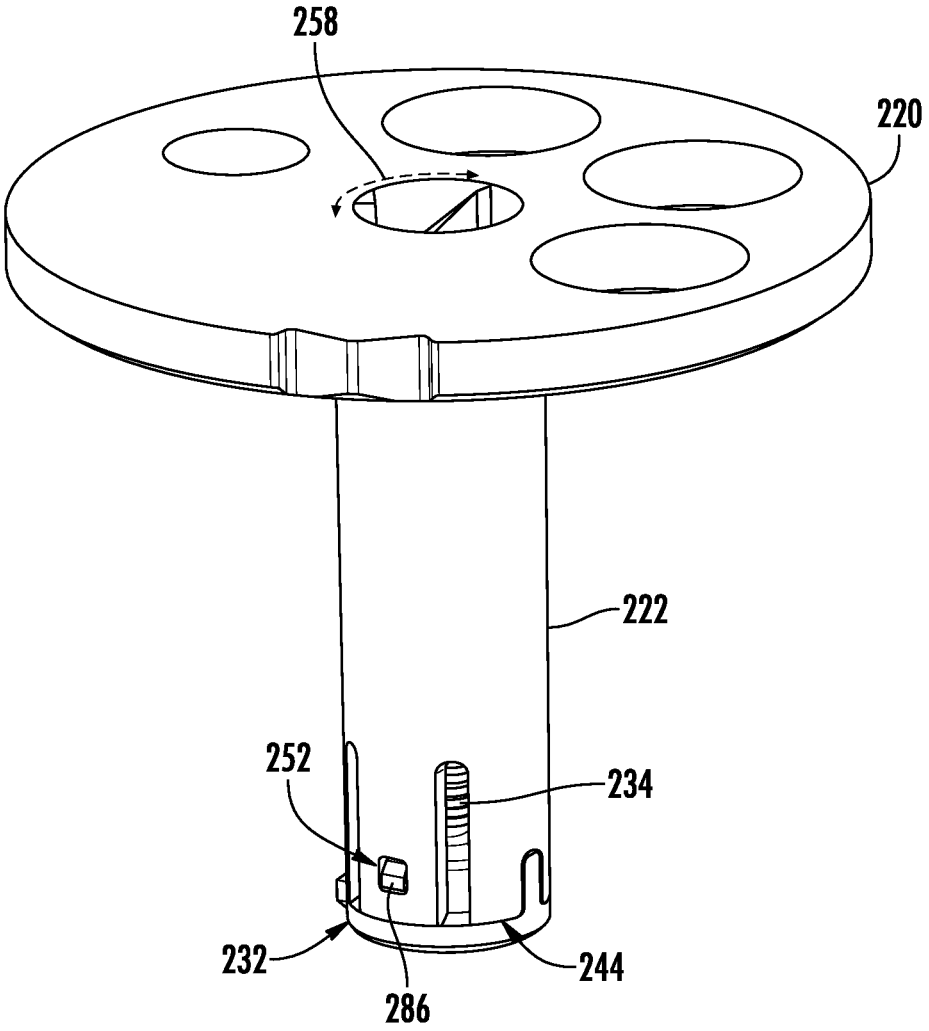
FIG. 14 is a cross-sectional elevation view of the exemplary diverter disk of FIG. 8.

As shown in FIGS. 10, 13, and 14, return spring 234 extends around guide shaft 282. Bottom end 292 attaches to lower spring guide 232 at spring base 284, proximal to the place guide shaft 282 attaches to spring base 284. Return spring further extends around guide shaft 282. Return spring 234 and guide shaft 282 extend into spring channel 278. Return spring 234 further attaches to upper spring guide 230 within spring channel 278, return spring 234 extending into spring channel 278. Top end 290 attaches to upper spring guide 230. For example, bottom end 292 of return spring 234 rests on spring base 284, with return spring coiled around guide shaft 282 and coiling inside spring channel 282. In some embodiments, top end 290 rests against or contacts a top of spring channel 282 in axial direction A. In certain embodiments, top end 290 attaches to upper spring guide 230 at inner disk wall 248, inside spring channel 178 and proximal to top surface 270 and apex 273. According to some embodiments, return spring 234 extends below upper spring guide 230 within disk channel 240. A portion of return spring 234 extends within a portion of upper shaft 276 into spring channel 278. Accordingly, a portion of guide shaft 282 extends within a portion of upper shaft 276 into spring channel 278.

Upper spring guide 230, lower spring guide 232, and return spring 234 may comprise a sub assembly 300, as shown in FIG. 13. Return spring 234 attaches to lower spring guide 232 at bottom end 292 of return spring 234 and extends axially therethrough (e.g., in axial direction A). For example, return spring 234 may rest bottom end 292 on spring base 284 and extend axially (e.g., in axial direction A) around guide shaft 282. A portion of guide shaft 282 may extend, with a portion of return spring 234, into spring channel 278 of upper spring guide in axial direction A. Return spring 234 may extend through spring channel 278, and top end 290 rests at a top 279 of spring channel 278 in axial direction A. Lower spring guide 232 is aligned with spring channel 278 such that guide shaft 282 removably insertable into spring channel 278.

Figure 9:
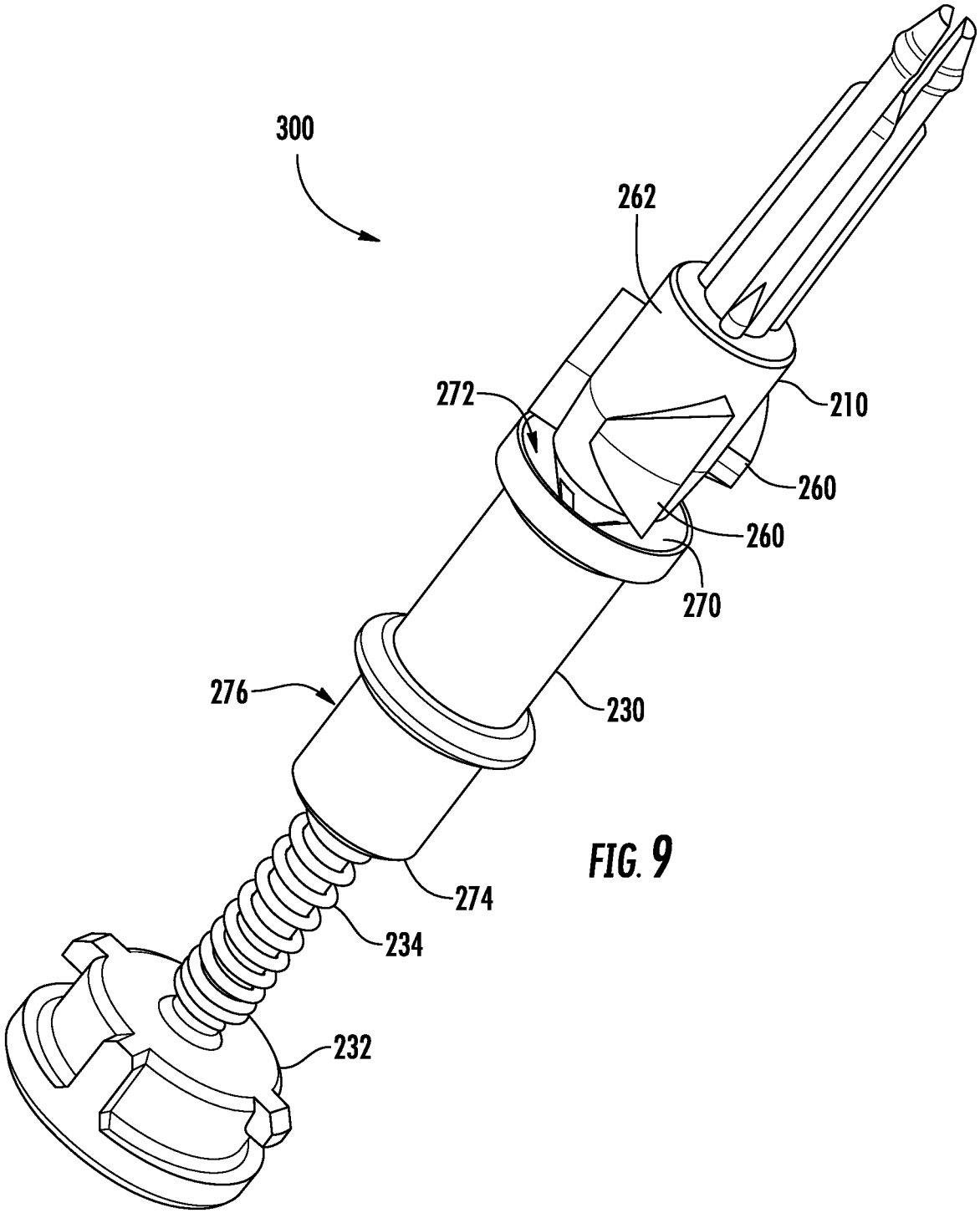
FIG. 9 is a perspective view of an exemplary sub assembly of the present disclosure.

As shown in FIGS. 9 and 10, upper spring guide 230 attaches to pin 210 at apex 273 of conical opening 272. Pin 210 is rotationally attached to upper spring guide 230 at apex 273 of conical opening 272 of upper spring guide 230, forming a touchpoint between apex 273 and pin 210. During use, pin 210 rotates in circumferential direction C (e.g., clockwise or counterclockwise) about apex 273. Additionally or alternatively, pin 210 may be located vertically above disk boss 222 and may extend in axial direction A below diverter head 220. Pin 210 may be moveably attached to upper spring guide 230. Advantageously, the touchpoint between apex 273 and pin 210 further allows pin 210 to rotate or spin about axial direction A without transferring rotational energy to upper spring guide 230 or to return spring 234.

Figure 6:
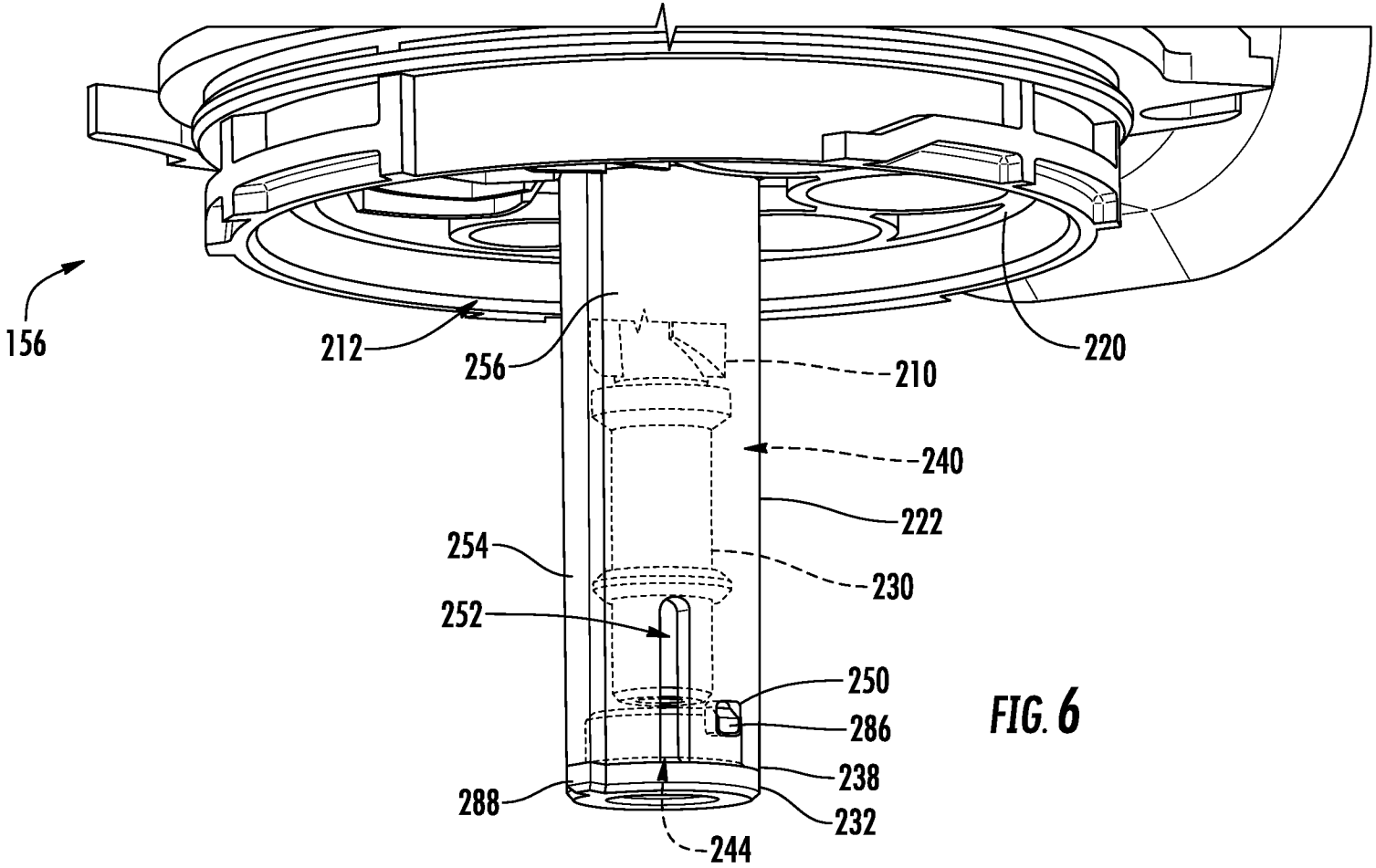
FIG. 6 is a perspective view of an exemplary diverter disk of the present disclosure and an exemplary diverter top of the present disclosure.

As shown in FIGS. 6, 10, and 14, lower spring guide 232 attaches to disk boss 222 at boss end 238. Tab 286 of lower spring guide 232 attaches through corresponding tab opening 250. Tab 286 attaches lower spring guide 232 to lower opening 244 of disk boss 222. Additionally or alternatively, tab notches 252 may allow a portion of disk boss 222 to flex outwardly during installation of lower spring guide 232, allowing tab 286 to move upward inside disk channel 240 from lower opening 244 to tab opening 250, and therethrough. Disk boss 222 can then flex into a final position, as shown in FIG. 6, 10, or 14. In some embodiments, alignment protrusion 288 is aligned with and attaches to alignment guide 254 of disk boss 222, aligning tab 286 with tab opening 250.

Figure 15:
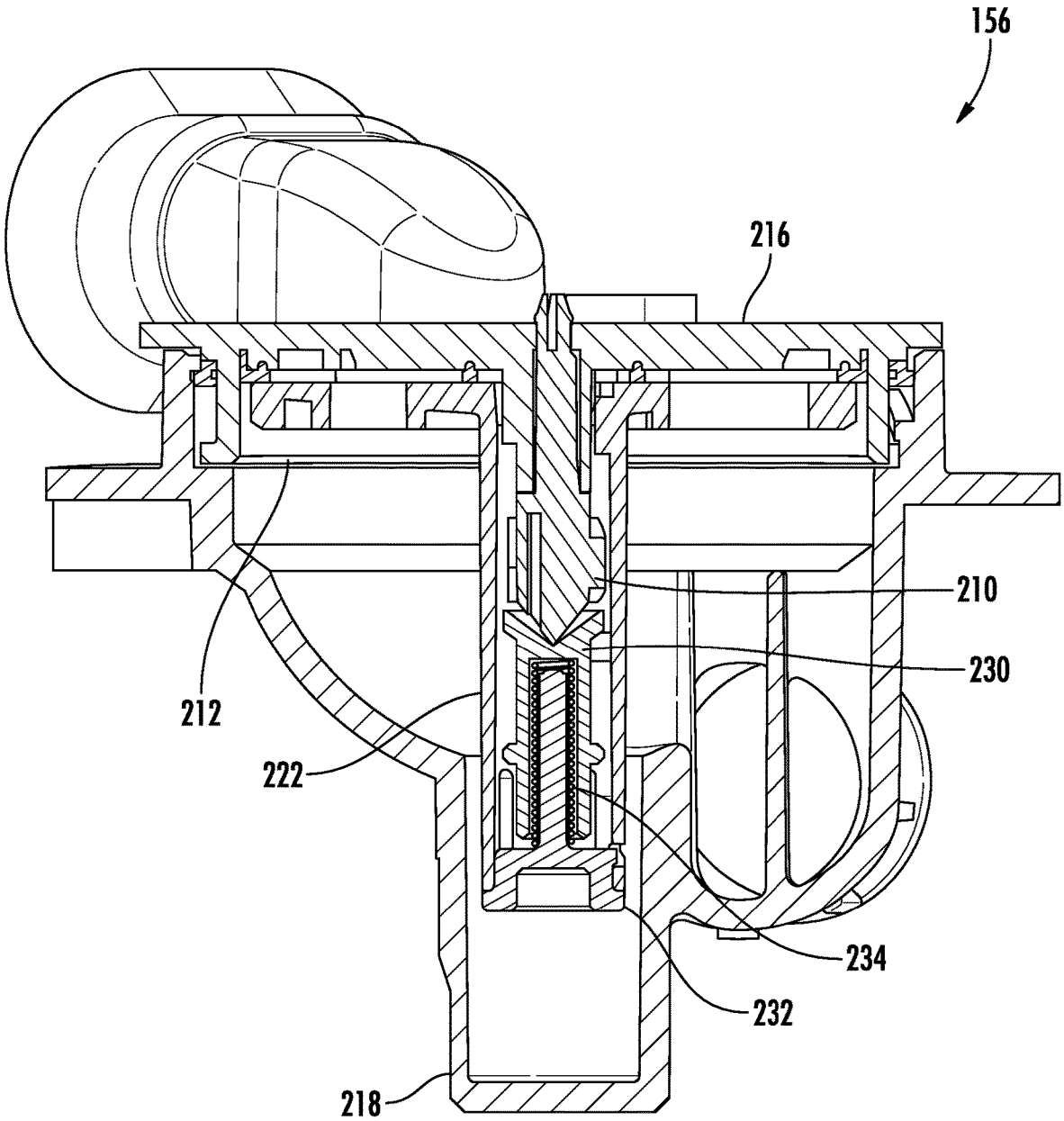
FIG. 15 is a cross-sectional elevation view of the portion of the diverter assembly of FIG. 3.
Figure 16:
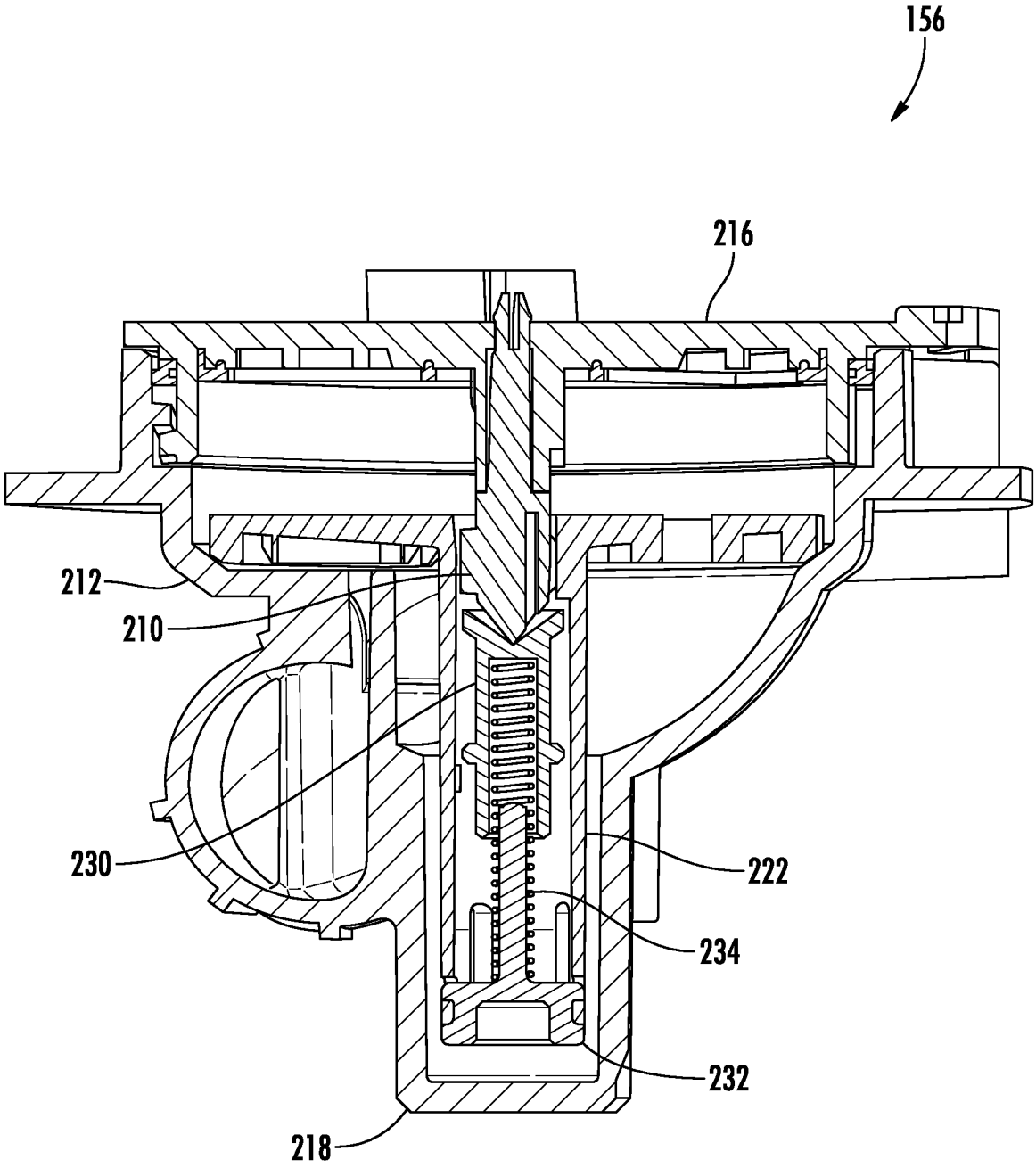
FIG. 16 is an alternate cross-sectional elevation view of the portion of the diverter assembly of FIG. 3.

Turning generally to FIGS. 15 and 16, diverter assembly 156 includes diverter disk 212 moveable along axial direction A between an upper position and a lower position. When assembled, diverter assembly 156 is movable between an extended position and a retracted position. Upper position of diverter disk 212 corresponds with retracted position of diverter assembly 156. Lower position of diverter disk 212 corresponds with extended position of diverter assembly 156. FIG. 15 depicts upper position of diverter disk 212 and retracted position of diverter assembly 156. FIG. 16 depicts lower position of diverter disk 212 and extended position of diverter assembly 156.

During use, diverter disk 212 is pressed into upward position by a flow of fluid into diverter assembly 156 by pump 152. Fluid flows into diverter assembly 156 and presses diverter disk 212 towards diverter top 216. Diverter assembly 156 is then in retracted position with return spring 234 in a retracted or coiled position inside spring channel 278 of upper spring guide 230. Guide shaft 282 of lower spring guide 232 is also then within spring channel 278 of upper spring guide. As shown, guide shaft 282 of lower spring guide 232 extends within spring channel 278 of upper spring guide 230 in retracted position. Return spring 234 is contracted within spring channel 278 and coiled around guide shaft 282. Disk boss 222 with upper spring guide 230, lower spring guide 232, and return spring 234 inside disk channel 240 raise vertically up in retracted position as well. Fluid may flow through one or more apertures 224, 226, 228 or 229 to allow fluid to flow through outlet one or outlet two and to spray assemblies 134, 140, or 142, as would be understood.

When pump 152 stops pumping fluid, such as to change positions of apertures 224, 226, 228, 229 during a cleaning cycle, pressure from fluid is released, allowing return spring 234 to relaxes, or returns to an extended position. With the relaxing of return spring 234, diverter disk 212 moves downward, such as along axial direction A or in vertical direction V, to lower position, as shown in FIG. 16, diverter disk 212 resting on a portion of diverter bottom 218. Diverter assembly 156 adjusts into extended position with return spring 234 relaxed. As shown, spring body 294 extends throughout both spring channel 278 and around guide shaft 282. Upper spring guide 230 in extended position may be vertically below the retracted position of upper spring guide 230. In extended position, at least a portion of lower spring guide 232 leaves spring channel 278 of upper spring guide 230, with guide shaft 282 leaving spring channel 278 (e.g., at least in part). A small portion of guide shaft 282 may remain in spring channel 278 in extended position. Advantageously, this portion of guide shaft 282 in spring channel 278 may serve to steady placement of sub assembly 300 within disk channel 240 while disk assembly is in extended position.

Diverter pin 210 generally rotates in circumferential direction C, and diverter disk 212 rotates in sync with pin 210. Protrusion 260 of diverter pin 210 generally aligns with grooves 246 of disk boss 222. Pin protrusion 260 further may align with grooves 246 in disk channel 240, thus raising pin 210 up to upper position and down to lower position, as shown in FIGS. 15 and 16, respectively.

Diverter disk 212 may rotate as it moves between upper position and lower position, with pin 210 rotating along grooves 246 in disk channel 240. Rotation may occur in circumferential direction C. Rotation of diverter disk 212 allows for different apertures 224, 226, 228, or 229 to align with diverter outlets 202 or 204. Thus, when different apertures align or misalign with diverter outlets 202 or 204, different spray assemblies receive fluid, depending on the alignment. For example, in some embodiments, the alignment of aperture 224 to diverter outlet 202 may allow fluid to flow to lower spray assembly 134. Other configurations may be used, including different numbers of apertures, diverter outlets, or spray assemblies, and different alignments may be used to generate different cycles, as would be understood.

Diverter pin 210 generally rotates in circumferential direction C, and diverter disk 212 rotates in sync with pin 210. Protrusion 260 of diverter pin 210 generally aligns with grooves 246 of disk boss 222, notably guiding relative movement between diverter head 220 and sub assembly 300. For example, grooves 246 may guide pin 210 to rotate during movement of diverter head 220 between first position and second position (in axial direction A), thereby rotating the position of diverter head in circumferential direction C.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, the dishwasher appliance defining a transverse direction, a lateral direction, and a vertical direction, the dishwasher appliance comprising:

a wash chamber for receipt of articles for washing;

a pump;

a spray assembly;

a diverter assembly in fluid communication with the pump and defining an axial direction, a radial direction, and a circumferential direction, the diverter assembly comprising a diverter disk moveable along the axial direction between an upper and a lower position, the diverter disk comprising:

a diverter head defining an opening and a radial center;

a disk boss attached to the diverter head at a radial center of the diverter head, the disk boss defining a disk channel extending along the axial direction below the diverter head;

an upper spring guide extending below the disk boss and located within the disk channel;

a return spring having a top end and a bottom end, the top end attached to the upper spring guide, the return spring extending below the upper spring guide within the disk channel; and a lower spring guide attached to the bottom end of the return spring and extending axially therethrough, wherein the lower spring guide further comprises a tab, the tab attaching through a corresponding tab opening, the tab attaching the lower spring guide to a lower opening of the disk boss.

2. The dishwasher appliance of claim 1, wherein the disk boss has an upper opening and a lower opening axially below the upper opening, wherein the upper opening is radially smaller than the lower opening, and wherein the upper spring guide has a radial circumference that is radially smaller than the lower opening and radially larger than the upper opening.

3. The dishwasher appliance of claim 1, wherein the upper spring guide further comprises a top surface, the top surface defining a conical opening.

4. The dishwasher appliance of claim 3, wherein the diverter assembly further comprises a pin, wherein the conical opening comprises an apex located centrally within the conical opening, and wherein the upper spring guide attaches to the pin at the apex of the conical opening, the pin rotationally attached at the apex of the conical opening of the upper spring guide, forming a touchpoint between the apex and the pin.

5. The dishwasher appliance of claim 1, wherein the upper spring guide further comprises a bottom end and an upper shaft, wherein the upper spring guide defines a spring channel, the spring channel extending from the bottom end of the upper spring guide along a portion of the upper shaft of the upper spring guide, and wherein the return spring further attaches to the upper spring guide within the spring channel, the return spring extending into the spring channel.

6. The dishwasher appliance of claim 1, wherein the lower spring guide further comprises a guide shaft and a spring base, the guide shaft extending from the spring base, and wherein the return spring further extends around the guide shaft and attaches to the lower spring guide at the spring base.

7. The dishwasher appliance of claim 1, wherein the return spring comprises a spring body, wherein the upper spring guide defines a spring channel, the spring channel extending from a base end of the upper spring guide into an upper shaft of the upper spring guide, wherein the return spring attaches to the upper spring guide within the spring channel, extending into the spring channel, wherein the lower spring guide further comprises a guide shaft and a spring base, the guide shaft extending from the spring base, wherein the return spring extends around the guide shaft and attaches to the lower spring guide at the spring base, and wherein a portion of the guide shaft extends within a portion of the spring body into the spring channel.

8. The dishwasher appliance of claim 7, wherein the diverter assembly is moveable between an extended position and a retracted position, and wherein the guide shaft extends within the spring channel when the diverter assembly is in the retracted position, the return spring contracted within the spring channel and coiled around the guide shaft.

9. The dishwasher appliance of claim 8, wherein the return spring relaxes in the extended position, extending the spring body throughout both the spring channel and around the guide shaft, and wherein the extended position of the upper spring guide is vertically below the retracted position of the upper spring guide.

10. The dishwasher appliance of claim 1, wherein the diverter assembly further comprises a pin located vertically above the disk boss and extending along the axial direction below the diverter head, and wherein the pin is moveably attached to the upper spring guide.

11. A diverter assembly for a dishwasher appliance, the diverter assembly in fluid communication with a pump and defining an axial direction, a radial direction, and a circumferential direction, the diverter assembly comprising:

a diverter disk moveable along the axial direction between an upper and a lower position, the diverter disk comprising a diverter head defining an opening and a radial center, a disk boss attached to the diverter head at the radial center of the diverter head, the disk boss defining a disk channel extending along the axial direction, wherein the disk boss defines a tab opening, an upper spring guide extending below the disk boss and located within the disk channel, a return spring having a top end and a bottom end, the top end attached to the upper spring guide, the return spring extending below the upper spring guide within the disk channel, and a lower spring guide attached to the bottom end of the return spring and extending axially therethrough, wherein the lower spring guide further comprises a tab, the tab attaching through the opening, the tab attaching the lower spring guide to the disk boss.

12. The diverter assembly of claim 11, wherein the upper spring guide further comprises a bottom end and an upper shaft, wherein the upper spring guide defines a spring channel, the spring channel extending from the bottom end of the upper spring guide into the upper shaft of the upper spring guide, and wherein the return spring attaches to the upper spring guide within the spring channel, extending into the spring channel.

13. The diverter assembly of claim 11, wherein the lower spring guide further comprises a guide shaft and a spring base, the guide shaft extending from the spring base, and wherein the return spring further extends around the guide shaft and attaches to the lower spring guide at the spring base.

14. The diverter assembly of claim 11, wherein the upper spring guide further comprises a top surface, the top surface defining a conical opening extending downward into the upper spring guide, the conical opening comprising an apex, and wherein the upper spring guide attaches to a pin at the top surface in the apex of the conical opening, the pin rotationally attached at the apex of the conical opening of the upper spring guide, forming a touchpoint between the apex and the pin.

15. The diverter assembly of claim 11, wherein the return spring comprises a spring body, wherein the upper spring guide defines a spring channel, the spring channel extending from a bottom end of the upper spring guide into a length of the upper spring guide, wherein the return spring attaches to the upper spring guide within the spring channel, extending into the spring channel, wherein the lower spring guide further comprises a guide shaft and a spring base, the guide shaft extending from the spring base, wherein the return spring extends around the guide shaft and attaches to the lower spring guide at the spring base, and wherein a portion of the guide shaft extends with a portion of the spring body into the spring channel.

16. The diverter assembly of claim 15, wherein the diverter assembly is moveable between an extended position and a retracted position, and wherein the guide shaft extends within the spring channel when the diverter assembly is in the retracted position, the return spring contracted within the spring channel and coiled around the guide shaft.

17. The diverter assembly of claim 16, wherein the return spring relaxes in the extended position, extending the spring body throughout both the spring channel and around the guide shaft, and wherein the extended position of the upper spring guide is vertically above the retracted position of the upper spring guide.

18. A dishwasher appliance comprising:

a pump;

a diverter assembly in fluid communication with the pump, the diverter assembly comprising a diverter disk moveable along an axial direction between an upper and a lower position, the diverter disk comprising:

a diverter head defining an opening and a radial center;

a disk boss attached to the diverter head at a radial center of the diverter head, the disk boss defining a disk channel extending along the axial direction below the diverter head, wherein the disk boss has an upper opening and a lower opening axially below the upper opening, wherein the upper opening is radially smaller than the lower opening, and wherein the upper spring guide has a radial circumference that is radially smaller than the lower opening and radially larger than the upper opening;

an upper spring guide extending below the disk boss and located within the disk channel;

a return spring having a top end and a bottom end, the top end attached to the upper spring guide, the return spring extending below the upper spring guide within the disk channel; and a lower spring guide attached to the bottom end of the return spring and extending axially therethrough.

19. The dishwasher appliance of claim 18, further comprises a pin, wherein the upper spring guide further comprises a top surface, the top surface defining a conical opening;

wherein the conical opening is configured to receive the pin.

* * * * *